US009022114B2

(12) United States Patent
Rankin

(10) Patent No.: US 9,022,114 B2
(45) Date of Patent: May 5, 2015

(54) CEMENT SHOE AND METHOD OF CEMENTING WELL WITH OPEN HOLE BELOW THE SHOE

(71) Applicant: E. Edward Rankin, Granbury, TX (US)

(72) Inventor: E. Edward Rankin, Granbury, TX (US)

(73) Assignee: Rite Increaser, LLC, Granbury, TX (US)

( * ) Notice: Subject to any disclaimer, the term of this patent is extended or adjusted under 35 U.S.C. 154(b) by 343 days.

(21) Appl. No.: 13/627,433

(22) Filed: Sep. 26, 2012

(65) Prior Publication Data

US 2013/0075094 A1 Mar. 28, 2013

Related U.S. Application Data

(60) Provisional application No. 61/539,289, filed on Sep. 26, 2011.

(51) Int. Cl.

| | |
|---|---|
| ***E21B 33/13*** | (2006.01) |
| ***E21B 33/14*** | (2006.01) |
| ***E21B 33/16*** | (2006.01) |
| ***E21B 41/00*** | (2006.01) |
| ***E21B 21/10*** | (2006.01) |

(52) U.S. Cl.

CPC ..... *E21B 33/14* (2013.01); *E21B 33/16* (2013.01); *E21B 41/00* (2013.01); *E21B 21/10* (2013.01)

(58) Field of Classification Search

CPC ..... E21B 33/13; E21B 36/16; E21B 33/134

USPC ..... 166/285, 291, 376, 383, 64, 154, 177.4, 166/242.8, 281

See application file for complete search history.

(56) References Cited

U.S. PATENT DOCUMENTS

2010/0108327 A1 * 5/2010 Swor et al. ..... 166/376

* cited by examiner

*Primary Examiner* — Cathleen Hutchins

(74) *Attorney, Agent, or Firm* — Bracewell & Giuliani LLP

(57) ABSTRACT

A casing shoe secured to a lower end of a casing string is positioned a selected distance from a bottom of the well, defining an open hole portion in the well below the casing shoe. Cement is pumped through the casing shoe and back up an annulus surrounding the casing string, while leaving at least part of the open hole portion free of cement. The annulus and the open hole portion are isolated from an interior of the casing string while the cement is uncured. The casing shoe has a timer that opens the interior of the casing string to the open hole portion after a selected time sufficient for the cement to cure. The operator may then pump a tool down the casing string while displacing fluid in the casing string below the tool through the casing shoe and into the open hole portion of the well.

16 Claims, 6 Drawing Sheets

CEMENT SHOE AND METHOD OF CEMENTING WELL WITH OPEN HOLE BELOW THE SHOE

CROSS REFERENCE TO RELATED APPLICATION

This application claims priority to provisional application 61/539,289, filed Sep. 26, 2011.

FIELD OF THE DISCLOSURE

This invention relates in general o well casing equipment and in particular a cement shoe and method of casing a well so as to leave an open rat hole below the shoe.

BACKGROUND

Drilling for hydrocarbon production, particularly gas, in shale formations often involves drilling a horizontal section in the well. In one technique, after the casing has been cemented, the operator runs a bridge plug and perforating gun on tubing into the horizontal part of the well. The operator sets the bridge plug and perforates the casing above the perforation. The operator may then retrieve the tubing and perforating gun and hydraulically fracture or "frac" the well by pumping fluid and proppants down the casing string and out the perforations. After the first perforation, the operator may run another bridge plug and perforation gun on a tubing string and repeats the frac operation. A number of zones may be perforated and tracked in this manner. Alternately, the operator may make a single run on tubing with a number of perforating guns and bridge plugs, and stage the setting and fracking of the various zones. In that instance, the frac fluid is pumped through the tubing.

In both techniques either a drilling rig or a workover rig is required to run the tubing. Many gas wells are produced without tubing being installed, and many operators prefer to frac through casing, rather than through tubing. Consequently, the tubing may be used only to enable the bridge plugs and perforating guns to be conveyed into the horizontal portion of the well. Having a drilling or workover rig on site for the perforating and frac operations adds to the expense of the well.

Bridge plugs and perforating guns in general can and are frequently deployed with wireline, rather than on tubing. The wireline may be deployed from a winch mounted to a truck, without requiring a drilling rig or workover rig. In a vertical well, gravity pulls the bridge plug and perforating gun into the well. However, if the well has a horizontal section, additional assistance is needed. Tractors powered though the wireline may be incorporated with the bridge plug and perforating gun to pull the equipment along the horizontal part of the well. Tractors, however, can be expensive and troublesome. Another way is to pump the perforating gun and bridge plug into the horizontal section. As the bridge plug moves downward, it pushes displaced fluid in the casing in front of or below it. Normally, the cementing of the casing, however, creates a closed chamber, with no place for the displaced fluid to flow, unless the well has already been perforated.

SUMMARY

The method includes seeming a casing shoe to a lower end of a casing string and running the casing shoe into the well a selected distance from a bottom of the well, defining an open hole portion in the well below the casing shoe. The operator pumps cement through the casing shoe and back up an annulus surrounding the casing string, while leaving at least part of the open hole portion free of cement. The operator isolates the annulus and the open hole portion from an interior of the casing string while the cement is uncured. The casing shoe has a timer that opens the interior of the casing string to the open hole portion after a selected time sufficient for the cement to cure. The open bore through the casing hanger allows the operator to pump a tool down the casing string, displacing fluid in the casing string below the tool through the casing shoe and into the open hole portion of the well.

The tool may be a bridge plug, which the operator sets in the casing string to isolate the open hole portion from the interior of the casing string above the bridge plug. The tool may also include a perforating gun, which the operator fires to create perforations in the casing string above the bridge plug. The operator may then pump fracturing fluid down the casing string and through the perforations. The bridge plug isolates the fracturing fluid from the open hole portion of the well.

The casing shoe may have a cylindrical sidewall having lateral ports through which the cement is pumped. The cement ports may be initially closed cement port plugs. Applying fluid pressure to the interior of the casing string dislodges the cement port plugs. The operator conveys down the casing string a closure element and lands it in the housing bore below the cement ports to block flow through the bore of the casing shoe into the open hole portion.

A cement plug is pumped down the casing string following the pumping of the cement. The timer may be part of a timer plug latched into a flow passage of the cement plug before the cement plug is pumped down. At the selected time, the timer unlatches the timer plug from the cement plug to enable flow through the flow passage of the cement plug. The operator may apply fluid pressure to the interior of the casing string after the timer plug has unlatched from the cement plug, expelling the timer plug from the flow passage of the cement plug and from the casing shoe.

DETAILED DESCRIPTION OF THE DISCLOSURE

Figure 1:
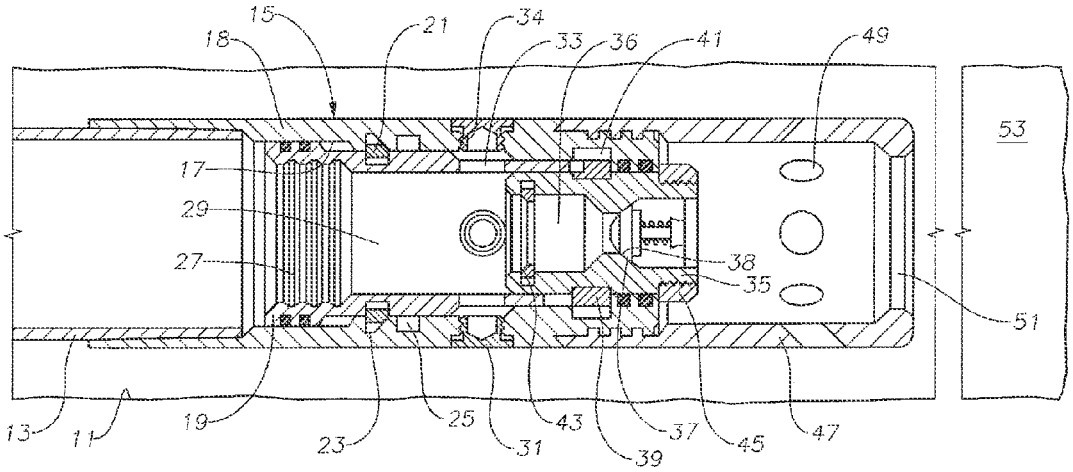
FIG. 1 is a sectional view of a cement shoe in accordance with this disclosure and shown in a wellbore prior to cementing.

Referring to FIG. 1, a horizontal portion of a wellbore 11 is illustrated. Wellbore 11 has an upper vertical portion, which is not shown, and is typically being drilled for shale gas production. A casing string 13 has been lowered into wellbore 11, but not yet cemented. Casing string 13 is conventional, being made up of joints of steel pipe secured to each other by threaded couplings.

A cement shoe 15 is secured to the lower end of casing string 13. Cement shoe 15 has a tubular housing 18 with a bore or central passage 17 extending through it along a longitudinal axis. Housing 18 has connection threads on its upper end, which may be internal, for securing to a lower end of casing string 13. The terms "upper" and "lower" are used only for convenience and not in a limiting manner. Although cement shoe 15 is shown in the horizontal portion of wellbore 11, the term "upper" describes herein the direction toward the top of wellbore, and the term "lower" refers to the bottom of wellbore 11.

A mandrel 19 is secured within passage 17 in an initial upper position relative to housing 18. The outer diameter of mandrel 19 is sealed to the inner diameter of passage 17. Mandrel 19 is retained within passage 17 by a retainer ring 21, which is a split ring. In the run-in position, retainer ring 21 is located within an upper annular groove 23 in passage 17. Upper annular groove 23 has an upper edge that is perpendicular to the axis of housing 18 and a lower edge that inclines downwardly and inwardly. An annular lower groove 25 is spaced axially downward from upper groove 23. In this example, both the upper and lower edges of lower groove 25 are perpendicular to the axis of housing 18. An internal plug profile 27 is formed in the upper end of a mandrel passage 29 that extends axially through mandrel 19. Plug profile 27 has a set of threads or parallel grooves.

Several cement port plugs 31 are secured within cement ports or holes 34 spaced circumferentially around the side wall of housing 18. Cement port plugs 31 seal holes 34 during run-in and are located radially outward from holes 33 formed in the side wall of mandrel 19.

A valve module 35 is initially secured within a lower end portion of mandrel passage 29 and protrudes from mandrel passage 29 into housing passage 17 of housing 18. Valve module 35 has a central, axially extending passage 36, which has a reduced diameter seat 38 within it. A float valve 37 is mounted in valve module passage 36 on the lower side of seat 38. Float valve 37 may be a conventional valve element biased by a spring against the lower side of seat 38 to block upward flowing fluid but allow downward flowing fluid. Valve module 35 is releasably held within mandrel passage 29 by a split retainer ring 39. Retainer ring 39 has an outer portion located in an annular recess 41 in shoe housing 18 and an inner portion that is within a mating annular recess in valve module 35. Recess 41 has an outer diameter sized so that when retainer ring 39 is forced to expand, the inner diameter of retainer ring 39 will be greater than the outer diameter of the mating recess in valve module 35, releasing valve module 35 from engagement with shoe housing 18. Mandrel 19 will push retainer ring 39 outward fully into recess 41 when mandrel 19 moves downward relative to valve module 35 from the upper position in FIG. 3 to the lower position in FIG. 4. The downward movement of mandrel 19 in housing 18 relative to valve module 35 thus releases valve module 35 from being retained within housing 18.

A split drop ball retainer ring 43 is mounted in an annular recess within an upper portion of valve module passage 36. A threaded lock nut 45 is secured to the lower end of valve module 35 and abuts a lower end of valve housing 18. Lock nut 45 prevents upward movement of valve module 35 relative to shoe housing 18 after retainer ring 39 has released valve module 35.

A guide shoe 47 secures by threads to the lower end of shoe housing 18. Guide shoe 47 is a tubular member that alternately could be integrally formed with shoe housing 18. Guide shoe 47 has circulating ports 49 spaced around its side wall and an open lower end 51. When casing string 13 is positioned at its desired depth, preferably a rat hole or an open hole lower portion 53 of wellbore 11 will extend beyond. The length of rat hole 53 may vary and could be only a few feet or less.

In operation, after wellbore 11 is drilled, casing string 13, along with cement shoe 15, will be run to a desired depth, leaving some rat hole 53. Because float valve 37 blocks upward flow, the operator fills casing string 13 from time to time as it is being run. Once at full depth, the operator may circulate drilling fluid or other fluid down casing string 13 and back up the annulus surrounding casing string 13 to condition wellbore 11. The downward flowing drilling fluid 59 flows through float valve 37 and out circulating ports 49 and open lower end 51 as indicated by the arrows in FIG. 2.

Figure 2:
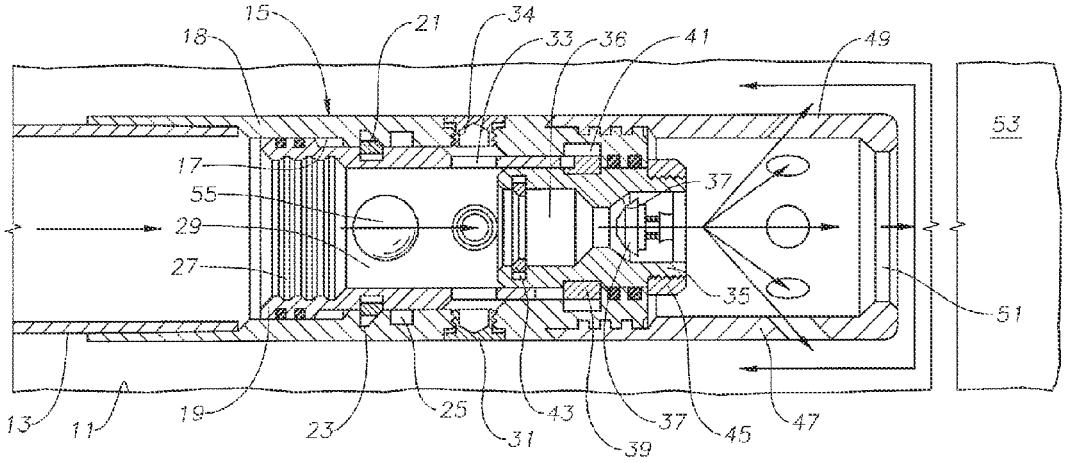
FIG. 2 is a sectional view of the cement shoe of FIG. 1, showing a ball being pumped into the shoe.

The operator then pumps down a closure member, preferably a ball 55, which lodges on the upper side receptacle of valve module seat 38. Retainer ring 43 allows ball 55 to move past into engagement with valve module seat 38, and then retains it within valve module passage 36. FIG. 2 illustrates ball 55 prior to landing in valve module seat 38. Once seated, ball 55 blocks flow downward through valve module 35. Float valve 37 blocks upward flow.

Figure 3:
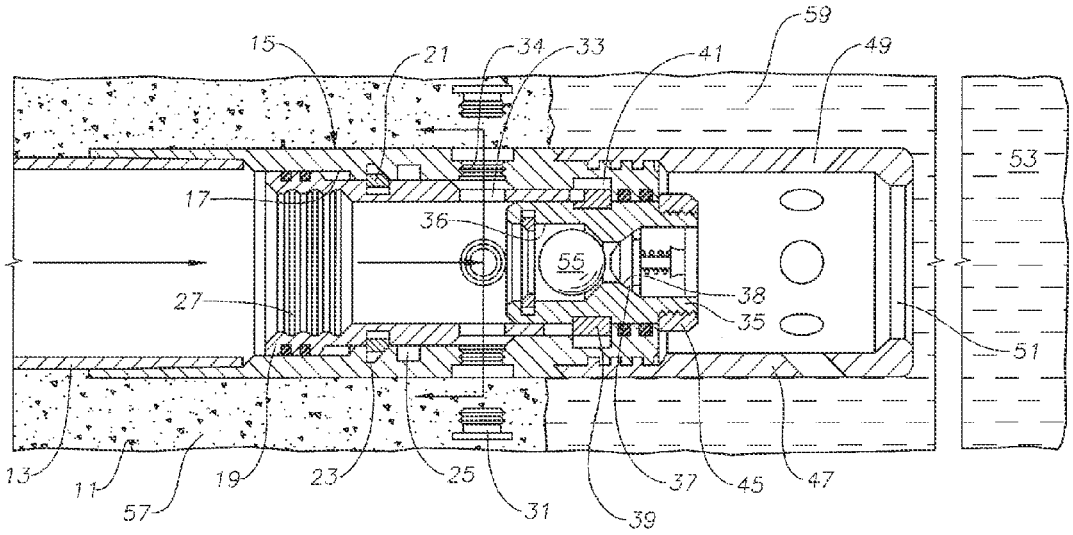
FIG. 3 is a sectional view of the cement shoe of FIG. 1, showing the ball landed on a seat in the shoe, fluid pressure being applied to dislodge cement port plugs from cement ports in the shoe, and cement being pumped down the casing and through the cement ports.

As shown in FIG. 3, the operator then increases the fluid pressure. The fluid pressure acts through mandrel cement ports 33 against cement port plugs 31. When the pressure is at a sufficient level, cement port plugs 31 will be expelled from housing plug holes 34, as illustrated in FIG. 3.

The operator may then begin cementing. Cement 57 flows through casing string 13, mandrel passage 29, mandrel cement ports 33 and out housing cement ports 34. Housing plug holes 34 are spaced some distance from the bottom end of guide shoe 47 and from the bottom of rat hole 53, which is filled with fluid 59, normally drilling fluid. Drilling fluid 59 located above housing plug holes 34 can be displaced upward toward the top of wellbore 11 by the flow of cement 57, but not downward because of the closed bottom of rat 53. As a result, cement 57 will only flow upward once exiting housing plug holes 34. Cement 57 will flow up the annulus surrounding casing string 13 a desired distance. Drilling fluid 59 remains in the annulus around guide shoe 47 and in rat hole 53.

Figure 4:
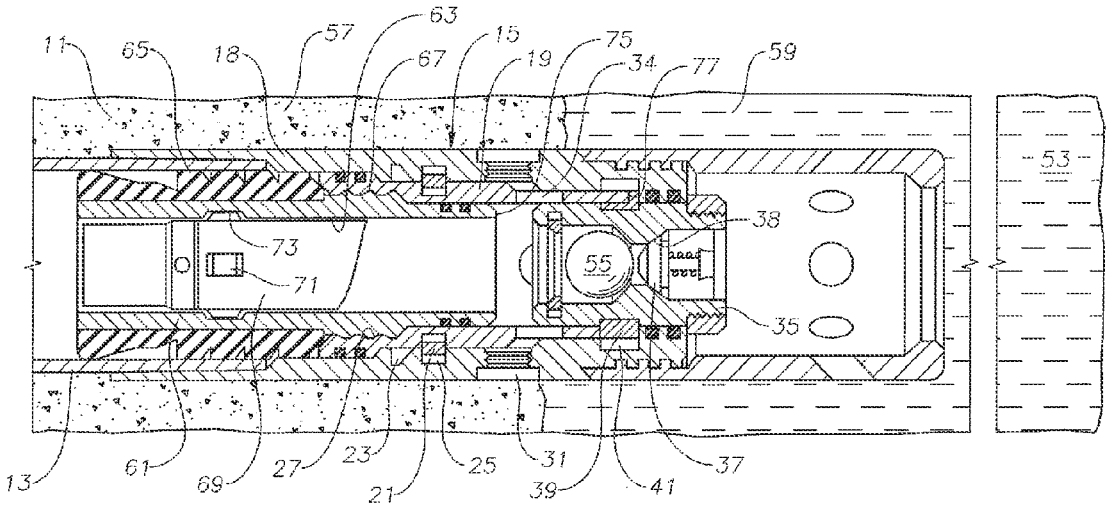
FIG. 4 is a sectional view of the cement shoe of FIG. 1, showing a cement plug that follows the cement and lands in the shoe.

As the last amount of cement 59 is pumped into the upper end of casing string 13, the operator will deploy a cement pump down plug 61, shown in FIG. 4. Pump down plug 61 has an axial bore 63 and a plurality of sealing ribs 65 of elastomeric material on its outer diameter. Sealing ribs 65 seal against the inner diameter of casing string 13 as pump down plug 61 moves downward. Pump down plug 61 has external locking ribs 67 extending circumferentially around a lower end.

A timer capsule or plug 69 is sealed within plug bore 63 initially, blocking flow through bore 63. Timer capsule 69 has a plurality of retractable dogs 71 that engage recesses 73 in plug bore 63 and prevent timer capsule 69 from axial movement relative to plug 61 while in the extended position shown. Timer capsule 69 has a retracting mechanism that is actuated by its timer, which is an internal clock (not shown). The timer of timer capsule 69 is set at a selected time to move dogs 71 from the extended position to the retracted position. A battery (not shown) supplies power to the clock and actuating mechanism. Timer capsule 69 has a lower end that is flush with pump down plug lower end 75 in this example.

Eventually pump down plug 61, along with timer capsule 69 will reach cement shoe 15, as shown in FIG. 4. Locking ribs 67 of plug 61 will lock into mandrel plug profile 27. Fluid pressure from a pump at the surface will apply sufficient pressure to cause mandrel 19 to move downward relative to housing 18 a short distance. Mandrel retainer ring 21 slips out of upper groove 23 and snaps into lower groove 25. Float valve module 35 does not move downward with mandrel 19 because of the engagement of retainer ring 39 with recess 41. During the downward movement of mandrel 19, the lower end 77 of mandrel 19 will push float valve module retainer ring 39 fully into recess 41, releasing module 35 from engagement with housing 18.

At this point, the cementing is completed. Float valve module 35 and cement pump down plug 61 cannot move upward in housing 18 and, along with timer capsule 69 as a back up, will retain any backflow of cement 59 that might occur prior to the curing of cement 57. The drilling rig may then move off the well site. Timer capsule 69 will have been previously set to release its dogs 71 from engagement with cement pump down plug 61 at a selected time. The time selected will be adequate time to assure that cement 57 has cured, such as 24 hours.

Figure 5:
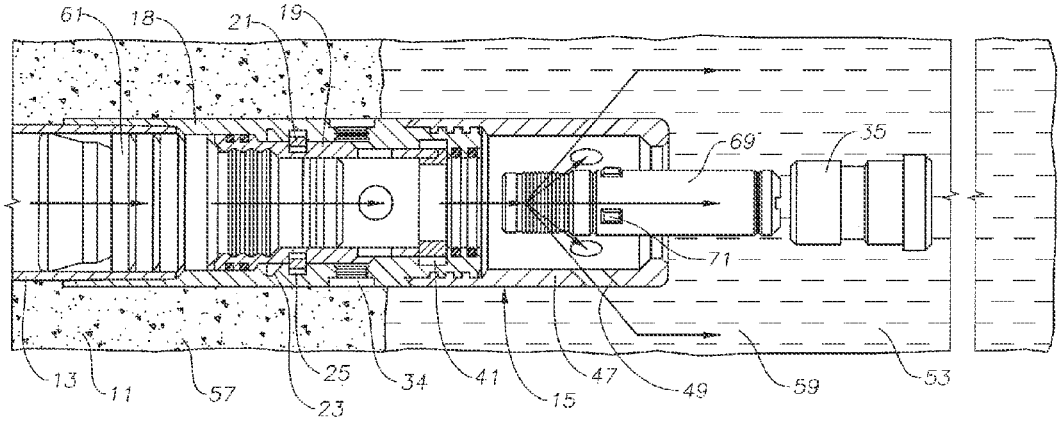
FIG. 5 is a sectional view of the cement shoe of FIG. 1, showing fluid pressure pumping out a timer capsule from the cement plug and the float valve assembly from the cement shoe.

Completion equipment will be brought to the well site to complete the well. In this example, wellbore 11 is intended to be hydraulic fractured or "fracked" at various points or stages along casing string 13 for producing gas. Production tubing is not required for this type of well; consequently a workover rig is not required. A perforating and logging truck, along with pumping facilities, may be all that is needed to prepare casing string 13 for fracking. The perforating and logging truck operator will install a blowout preventer and lubricator on the wellhead. Timer capsule 69 may have already released its dogs 71 from cement pump down plug 61, even before arrival of the perforating and logging truck. Otherwise, the perforating and logging truck operator will wait under timer capsule 69 has released dogs 71 from pump down plug 61. Once that has occurred, the operator pumps fluid down casing string 13 to apply sufficient pressure to push timer capsule 69 from cement plug 61. The amount of fluid pressure can be relatively low because the only engagement of timer capsule 69 to pump down plug 61 is friction. As timer capsule 69 is expelled, it contacts float valve module 35, which previously was released from housing 18, and pushes it from cement shoe 15 into rat hole 53, as shown in FIG. 5. Ball 55 will also be expelled into rat hole 53. Pump down plug 61 remains attached to mandrel 19, but its bore 63 is open. At this point, well bore 11 is no longer a sealed container since rat hole 53 is not cased. Rather rat hole 53 provides access to a porous, permeable formation.

Figure 6:
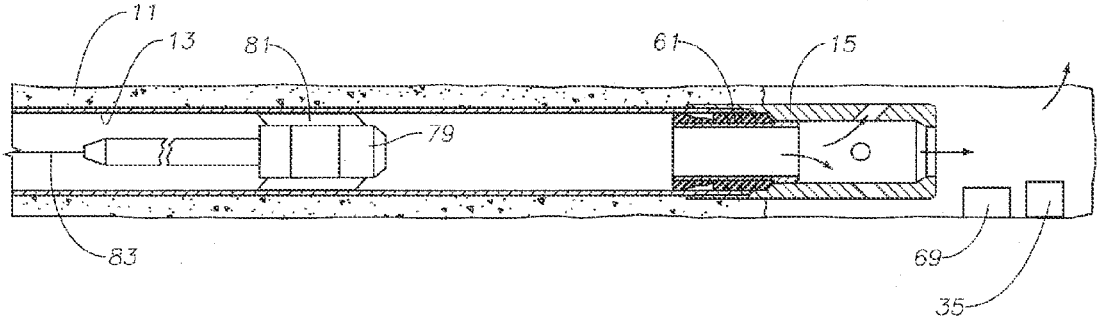
FIG. 6 is a sectional view illustrating the cement shoe after the tither capsule and float valve assembly have been dislodged and a downhole tool assembly being pumped down the well.

The operator may then lower a downhole tool or assembly 79 into casing 13 as shown in FIG. 6. Downhole assembly 79 optionally may include equipment for logging or surveying the wellbore 11 as well as measuring the gauge or inner diameter of casing 13. Fluid is pumped down the wellbore 11 to push downhole assembly 79 along the horizontal portion of wellbore 11. Downhole assembly 79 may have seals 81 that seal to the inner diameter of casing string 13 to facilitate the pumping action. Preferably, downhole assembly 79 is deployed on a wire line or logging cable 83. The displaced fluid in front of downhole assembly 79 is pushed toward and into rat hole 53, where it flows into the earth formation. As the operator begins retrieving downhole assembly 79 with cable 83, the wellbore 11 may be surveyed.

Multiple runs of various types of downhole assemblies 79 may be made, including installing a bridge plug within casing string 13 above cement shoe 15 to isolate the open hole that exists in rat hole 53. After perforating casing string 13 above the bridge plug, the operator may frack the formation where perforated by pumping high pressure fluid and proppants into casing string 13. The bridge plug set just above cement shoe 15 isolates rat hole 53 from the high pressure fracking fluid. After the first track procedure has been completed, the operator may again pump down downhole assembly 79 on cable 83 to set another bridge plug above the first set of perforations. Displaced fluid in front of the downhole assembly 79 cannot flow into rat hole 53 because the first bridge plug blocks the flow. However, the displaced fluid can flow through the first set of perforations into the formation. The operator will perforate a second set of perforations above the second bridge plug and repeat the fracking operation. Several bridge plugs and perforations may be made in this manner.

After all have been completed, the operator may pump downhole assembly 79 back into casing string 13 and retrieve the bridge plugs, one by one, so as to open all of the fracked formations to casing string. Alternately, the operator may drill out the bridge plugs, but that would require equipment capable of drilling bridge plugs. The lowest bridge plug may remain in place to maintain isolation of rat hole 53.

While the invention has been shown in only one of its forms, it should be apparent to those skilled in the art that it is no so limited but is susceptible to various changes without departing from the scope of the invention.

The invention claimed is:

1. A method of completing a well, comprising:

(a) securing a casing shoe to a lower end of a casing string and running the casing shoe into the well a selected distance from a bottom of the well, defining an open hole portion in the well below the casing shoe;

(b) pumping cement through the casing shoe and back up an annulus surrounding the casing string, while leaving at least part of the open hole portion free of cement;

(c) isolating the annulus and the open hole portion from an interior of the casing string while the cement is uncured;

(d) providing the casing shoe with a timer that opens the interior of the casing string to the open hole portion after a selected time sufficient for the cement to cure; and (e) pumping a tool down the casing string, and displacing fluid in the casing string below the tool through the casing shoe and into the open hole portion of the well.

2. The method according to claim 1, further comprising providing the casing shoe with a cylindrical sidewall having lateral ports, and pumping cement through the casing shoe comprises pumping the cement through the lateral ports into the annulus.

3. The method according to claim 1, further comprising:

providing the casing shoe with a bore, a cylindrical sidewall having lateral cement ports, and closing the cement ports with cement port plugs; wherein pumping cement through the casing shoe comprises applying fluid pressure to the interior of the casing string to dislodge the cement port plugs; and flowing the cement through the cement ports into the annulus.

4. The method according to claim 1, wherein:

securing the casing shoe comprises providing the casing shoe with a bore, a cylindrical sidewall having lateral cement ports, and cement port plugs closing the cement ports; and pumping cement through the casing shoe comprises conveying a closure element down the casing string into the bore below the cement ports to block flow through the bore of the casing shoe into the open hole portion, then applying fluid pressure to the interior of the casing string to dislodge the cement port plugs, and flowing the cement through the cement ports into the annulus.

5. The method according to claim 1, wherein:

isolating the annulus comprises pumping a cement plug down the casing string following the pumping of the cement and latching the cement plug in the casing shoe;

providing the casing shoe with the timer comprises placing the timer in a timer plug and latching the timer plug in a flow passage of the cement plug before step (c) to block flow through the cement plug; and providing the casing shoe with the timer further comprises, with the timer, unlatching the timer plug from the cement plug to enable flow through the flow passage of the cement plug.

6. The method according to claim 5, further comprising applying fluid pressure to the interior of the casing string after the timer plug has unlatched from the cement plug, and expelling the timer plug from the flow passage of the cement plug and from the casing shoe.

7. A well casing shoe assembly, comprising:

a cylindrical housing have a housing bore and a connection end for securing to a lower end of a casing string;

a cement plug adapted to be conveyed down the casing string to close the housing bore following the pumping of cement through the housing bore to prevent back flow of the cement while still uncured;

a timer incorporated with the cement plug that opens the housing bore after a selected time sufficient to enable the cement to cure; wherein:

the cement plug has a flow passage extending through it;

the timer comprises a timer plug with a latch mechanism that latches the timer plug into the flow passage so as to block flow through the flow passage; and the timer causes the latch mechanism to unlatch the timer plug after the selected time, allowing fluid pressure to be applied to the casing string to expel the timer plug from the flow passage.

8. The shoe assembly according to claim 7, further comprising:

a plurality of cement ports extending through a sidewall of the housing;

a closure member adapted to be conveyed down the casing string to land in the housing bore below the cement ports and block downward flow through the housing so as to direct cement out the cement ports.

9. The shoe assembly according to claim 8, further comprising:

a closure member receptacle that latches into the housing bore for receiving the closure member; and wherein the timer plug dislodges the closure member receptacle from the housing bore when the timer plug is expelled from the flow passage.

10. The shoe assembly according to claim 8, further comprising cement port plugs initially located in the cement ports, the cement port plugs being capable of being expelled from the cement ports in response to fluid pressure applied to the casing string after the closure member has landed in the housing bore.

11. The shoe assembly according to claim 8, further comprising:

a valve module latched into the housing bore, the valve module having on a lower side a float valve that blocks upward flow through the housing bore, the valve module having a closure member receptacle on an upper side for receiving the closure member; and wherein the timer plug dislodges the valve module from the housing bore when the timer plug is expelled from the flow passage.

12. The shoe assembly according to claim 7, further comprising:

a plurality of cement ports extending through a sidewall of the housing;

a closure member receptacle latched into the housing bore below the cement ports;

a closure member adapted to be conveyed down the casing string to land in the closure member receptacle and block downward flow through the housing so as to direct cement out the cement ports;

a closure member receptacle latch member that engages a latch profile in the housing bore to retain the closure member receptacle;

a mandrel carried within the housing bore between an upper position and a lower position, the mandrel having a lower end that engages and releases the closure member receptacle latch member while in the lower position; and the mandrel has a mandrel bore into which the cement plug lands, and the landing of the cement plug moves the mandrel to the lower position.

13. A well casing shoe assembly, comprising:

a cylindrical housing have a housing bore and a connection end for securing to a lower end of a casing string;

a plurality of cement ports extending through a side wall of the housing;

a closure member receptacle in the housing bore below the cement ports;

a closure member adapted to be conveyed down the casing string and landed in the closure member receptacle for blocking downward flow below the housing and directing cement pumped down the casing string out the cement ports;

a cement plug adapted to be conveyed down the casing string into the housing bore following the pumping of cement through the cement ports to prevent back flow of cement while still uncured;

a timer plug latched into a flow passage of the cement plug by a latching mechanism;

a timer within the timer plug that causes the latching mechanism to release the timer plug after a selected time sufficient to enable the cement to cure, enabling fluid pressure to be applied to the casing string to expel the timer plug from the flow passage; and wherein the closure member receptacle is releasable from the housing bore so as to be expelled along with the timer plug.

14. The shoe assembly according to claim 13, further comprising cement port plugs initially located in the cement ports, the cement port plugs being capable of being expelled from the cement ports in response to fluid pressure applied to the casing string after the closure member has landed in the closure member receptacle.

15. The shoe assembly according to claim 13, further comprising:

a cement float valve mounted to the closure member receptacle for preventing upward flow through the housing bore.

16. The shoe assembly according to claim 13, further comprising:

a closure member receptacle latch member that engages a latch profile in the housing bore to retain the closure member receptacle;

a mandrel carried within the bore between an upper position and a lower position, the mandrel having a lower end that engages and releases the closure member receptacle latch member while in the lower position; and wherein the mandrel has a mandrel bore into which the cement plug lands, and the landing of the cement plug moves the mandrel to the lower position.

* * * * *